US005236095A

United States Patent [19]

Krizka

[11] Patent Number: 5,236,095

[45] Date of Patent: Aug. 17, 1993

[54] BUMPER RACK ASSEMBLY

[76] Inventor: Allen J. Krizka, 5245 S. Mason Ave., Chicago, Ill. 60638

[21] Appl. No.: 913,926

[22] Filed: Jul. 17, 1992

[51] Int. Cl.[5] ..... A47F 5/00

[52] U.S. Cl. ..... 211/96; 211/102; 211/105.3; 211/168

[58] Field of Search ..... 211/96, 102, 103, 105.3, 211/105.4, 168, 175, 87

[56] References Cited

U.S. PATENT DOCUMENTS 633,987 10/1899 Clough ..... 211/103 X
1,265,524 5/1918 Sandermann ..... 211/102
2,336,604 12/1943 Edward et al. ..... 211/103 X
2,987,193 6/1961 Paior ..... 211/96 X
3,139,187 6/1964 Wolfson et al. ..... 211/168 X
3,635,352 1/1972 Brooks et al. ..... 211/168 X
4,878,586 11/1989 Bancroft et al. ..... 211/87 X
5,033,630 7/1991 Lee ..... 211/168 X

*Primary Examiner*—Robert W. Gibson, Jr.
*Attorney, Agent, or Firm*—Myers & Associates, Ltd.

[57] ABSTRACT

A rack assembly including a plurality of vertical tubes anchored adjacent to a sidewall. A plurality of arm assemblies are affixed to the vertical tubes and are vertically and pivotally adjustable. The arm assemblies collectively serve as support members for various objects. Some embodiments permit adjustment of the arm assemblies.

10 Claims, 2 Drawing Sheets

BUMPER RACK ASSEMBLY

BACKGROUND OF THE INVENTION

1. Field of the Invention

This invention relates in general to support racks and more particularly, to a rack assembly having adjustable support arms.

2. Description of the Prior Art

As is well known support racks of many designs are common fixtures in a wide range of applications. One environment in which support racks are present is in repair shops of many kinds, such as at a body repair facility and other shops in which it is desirable to at least temporarily support an item during repair. To adequately serve a repair facility, the repair rack must possess suitable strength to support heavy objects and have a range of versatility to accommodate various shapes of objects being supported. In addition to the foregoing characteristics, it is desirable that the rack have a space saving design to occupy a minimum area when not in use and when being employed to support a object. Finally, it is desirable that the rack assembly possessing the foregoing characteristics be relatively inexpensive to manufacture for economy of installation in a repair shop and other applications of use.

SUMMARY OF THE INVENTION

It is an objective of the invention to provide an improved adjustable rack assembly having vertical support members retained in anchored relationship on a wall and the like. The support members are in the form of one or more elongated tubular members having a plurality of adjustable arms. The adjustable arms can be swung from a storage position against a vertical wall to any angular orientation relative to the elongated support members as needed during use. The support arms can be clamped at selected orientations for adjustable and adequate support of the object being retained on the rack assembly of the invention. One use of a rack assembly of the invention is in a body repair shop where a bumper can be safely stored while repair work is performed on a vehicle. The invention of the application possesses versatility of use, adequate strength to retain even the heaviest objects, and occupies a minimum area within a facility.

DESCRIPTION OF THE PREFERRED EMBODIMENTS

Figure 1:
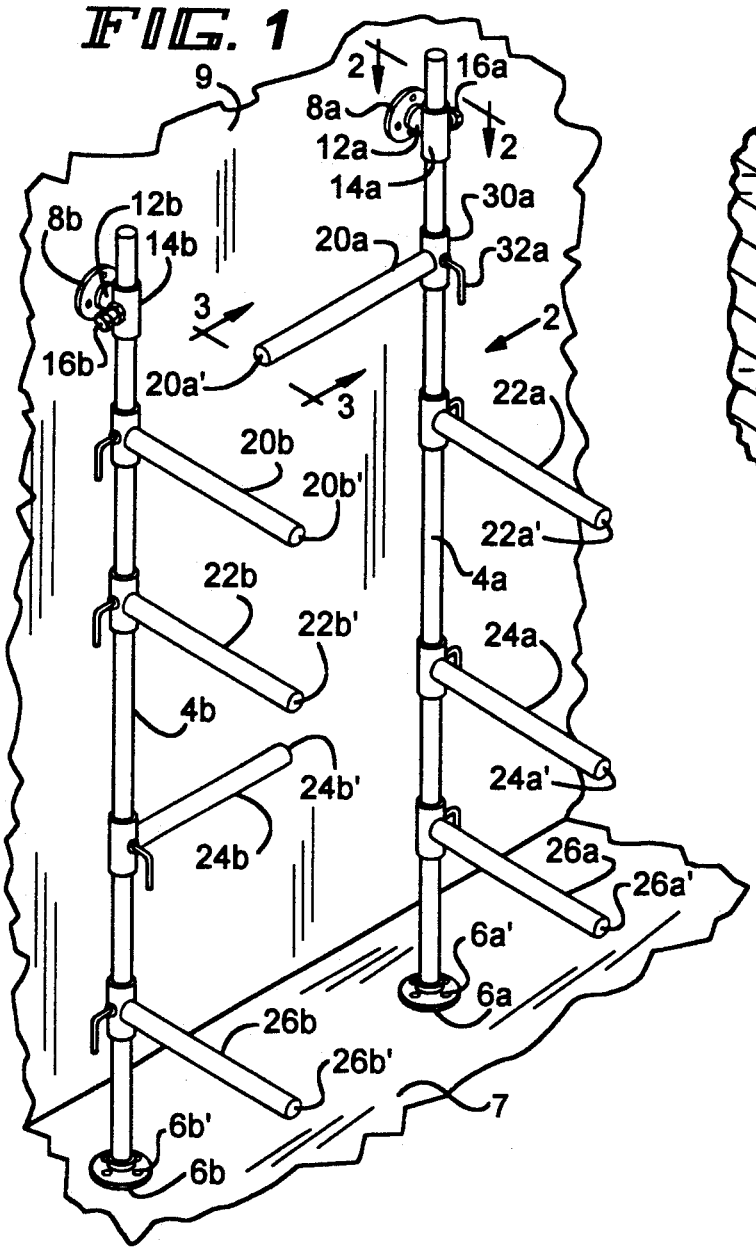
FIG. 1 is a front perspective view of the rack assembly of the invention mounted on a wall.

Referring now to FIG. 1, there is illustrated a preferred embodiment of the rack assembly of the invention, generally designated by reference numeral 2. Rack assembly 2 includes a pair of upright, tubular metal support members 4*a* and 4*b* that are anchored in fixed position. Although two vertical support tubes 4*a*, 4*b* are shown in FIG. 1, it is within the scope of the invention to utilize additional fixed vertical support tubes at adjoining locations to either increase the span of the rack assembly of the invention or to provide greater support strength. As seen in FIG. 1, the bottom end of vertical tubes 4*a* and 4*b* are anchored at their bottom ends respectively by plates 6*a*, 6*b* which are affixed by threaded fastened elements to the floor 7. The circular plates 6*a*, 6*b* are formed with upper raised flanges 6*a*', 6*b*' having an open end substantially conforming to the shape of the lower end of the vertical support tubes 4*a*, 4*b* for retention therein. Alternatively, the lower ends of the vertical support tubes 4*a*, 4*b* can be retained on a vertical side wall in a manner to be described.

Figure 2:
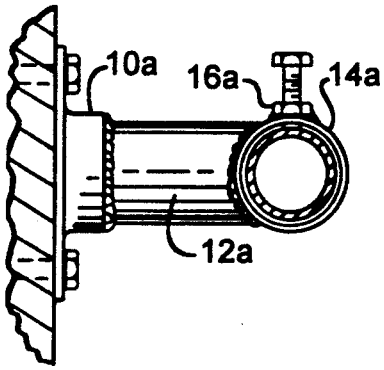
FIG. 2 is a partial top plan view taken along lines 2—2 of FIG. 1.
Figure 3:
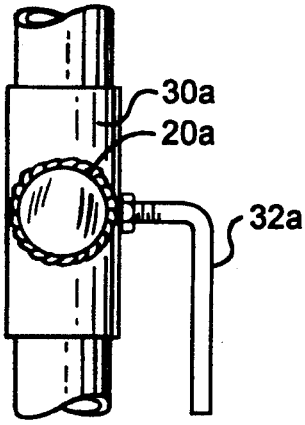
FIG. 3 is a partial side elevational view taken along lines 3—3 of FIG. 1.

The upper end portion of tubular vertical support tubes 4*a*, 4*b* are anchored by plates 8*a*, 8*b* to the side wall 9 through suitable threaded fasteners (not shown). The plate 8*a* is formed with a circular raised flange 10*a* which interfits in a welded connection to a short, tubular support member 12*a*, 12*b*. As best shown in FIG. 2, the tubular support 12*a* is welded to a vertically oriented tubular sleeve 14*a*. A threaded member 16*a* is externally threaded through the tubular sleeve 14*a* and extends through the sleeve wall to releasably engage the vertical support tube 4*a* for retention therein. The support of the vertical support member 4*b* further includes an identically designed support tube 12*b*, vertical tube 14*b*, and threaded member 16*a* as the elements correspondingly are shown in FIG. 2. In addition, a support fixture assembly (not shown) and as exemplified by plates 8*a*, 8*b* can further be affixed to the sidewall 9 as an alternative manner of retaining and anchoring the lower end of the vertical support tubes 4*a*, 4*b* with its end elevated above the floor 7.

As seen in FIG. 1, the mounting of the vertical support tube 4*a*, 4*b* spaces them from the wall 9 for an amount dependent on the length of supports 12*a*, 12*b* and the mounting on the floor 7. A plurality of arm assemblies 22*a*, 24*a*, and 26*a* are pivotally supported for movement in a horizontal plane on vertical support tube 4*a*. Similarly, as shown in FIG. 1, a plurality of support arm assemblies 20*b*, 22*b*, 24*b* and 26*b* are supported for pivotal movement on vertical support tube 4*b* for swinging movement in a generally horizontal plane. The configuration of the support arms assemblies mounted on both vertical support tubes 4*a* and 4*b* correspond to the arm assembly 20*a* most clearly illustrated in FIGS. 4 and 5.

Figure 4:
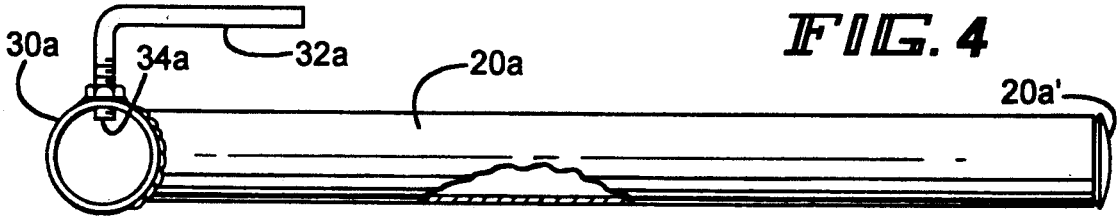
FIG. 4 is a top plan view, with parts in section, of a support arm of the rack assembly of FIG. 1.
Figure 5:
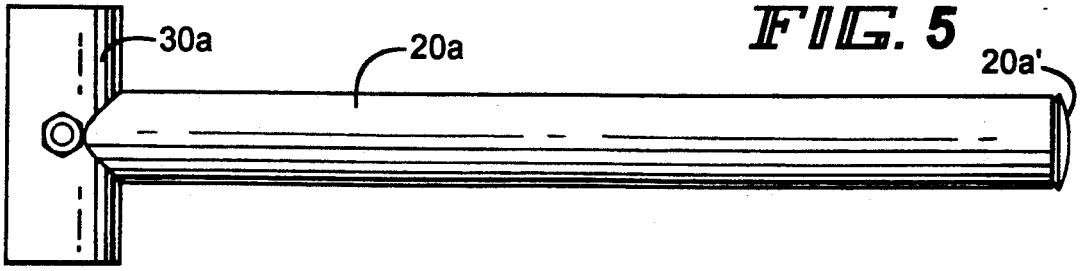
FIG. 5 is a front elevational view of the support arm of FIG. 4.
Figure 9:
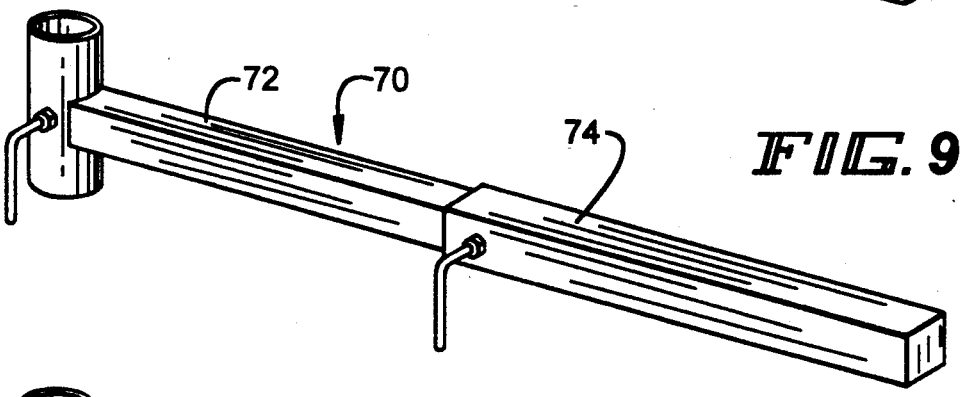
FIG. 9 is a fifth embodiment of a support arm for use with the rack assembly of FIG. 1.

As seen in FIGS. 4 and 5, the support arm assembly 20*a* is affixed at one end to a support tube 30*a* having a hollow body through which the vertical support arm 4*a* extends. A set key 32*a* having an angle configuration and a threaded end extending through the support sleeve 30*a* acts to engage the vertical support tube 4*a* upon tightening the set key. Thus, the support arm can be retained at a storage location adjacent the wall 9, such as shown in FIG. 9, or swung out at any angle in a horizontal plane upon release of the set key 32*a*. Upon release of the set key 32*a*, not only is the support arm assembly 20*a* capable of assuming any angle in relation to the wall 9, but may be vertically adjusted as desired for given applications.

The remaining support arm assemblies 22*a*, 24*a*, 26*a* and the support arm assemblies 20*b*, 22*b*, 24*b*, 26*b* mounted on vertical support tube 4*b* all are identically supported and have substantially the same structure as described in relation to FIG. 1. Each of the support arm assemblies may be closed at their open tubular ends by pipe plugs 20*a*', 22*a*', 24*a*' and 26*a*' for the arm assemblies on vertical tubular member 4*a*. Similarly, the ends of the support arm assemblies 20*b*, 22*b*, 24*b*, and 26*b* are supported on vertical support tube 4*b* may be closed by pipe plugs 20*b*', 22*b*', 24*b*', and 26*b*'. Thus, in supporting an object, such as an automobile fender, selective support arms may be swung away from the wall 9, and angularly and vertically oriented with respect to each other in a manner to best carry an object being supported. The independent adjustments of the plurality of horizontal arm assemblies provides a wide magnitude of adjustments to greatly increase the versatility of the rack assembly 2 of the invention.

Figure 6:
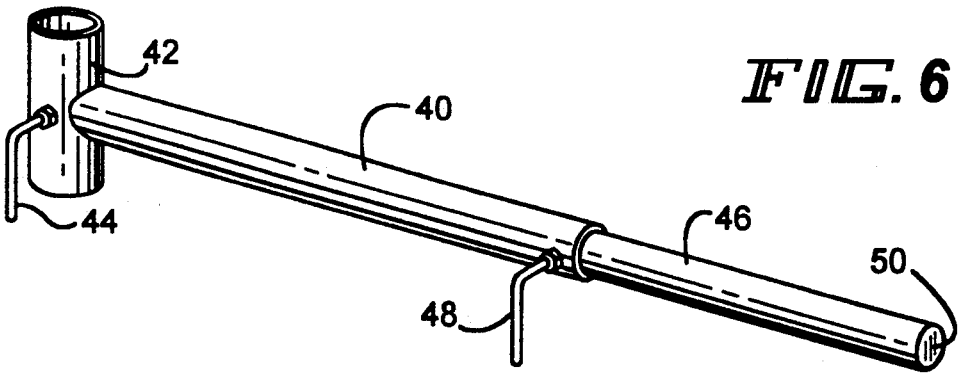
FIG. 6 is a perspective front view of a second embodiment of a support arm for use in the rack assembly of FIG. 1.

In FIG. 6 as illustrated, a second embodiment of the invention in which an extendable arm assembly 40 of the invention is shown to increase the versatility and capability of the rack assembly 2 of FIG. 1. The extendable arm assembly 40 includes a support sleeve 42 and set key 44 for retaining the extendable arm assembly 40 on either of the vertical support tubes 4*a*, 4*b*. The open end of tubular member 40 is provided with an internal telescopic extension 46 which may be set and fixed in an adjusted position by an additional set key 48 threadedly engaging a welded nut and the like formed in the end of the tube 40. The end of the extendable end 46 can be closed by a pipe plug 50. As should be apparent, the extendable support arm 46 can adjustably increase the overall length of the arm to carry wider objects as may be needed. The extendable arm configuration can be utilized as one or selected ones of the arm assemblies illustrated in FIG. 1 as supported on both the vertical tubes 4*a*, 4*b*.

Figure 7:
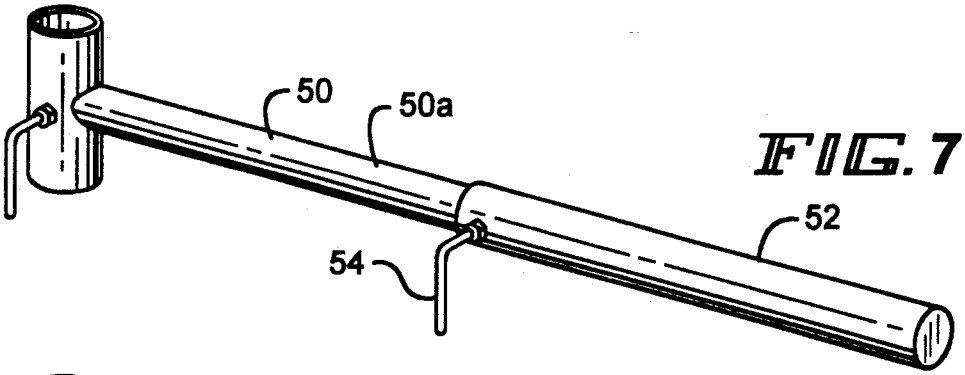
FIG. 7 is a front perspective view of a third embodiment of a support arm for use in the rack assembly in FIG. 1.

FIG. 7 shows an additional extended arm assembly 50 having a similar configuration as the extendable arm assembly 40 except that the adjustable extendable end 52 has a diameter greater than the diameter of tube 50*a* and the set key 54 is threadedly retained through the extendable end 52.

Figure 8:
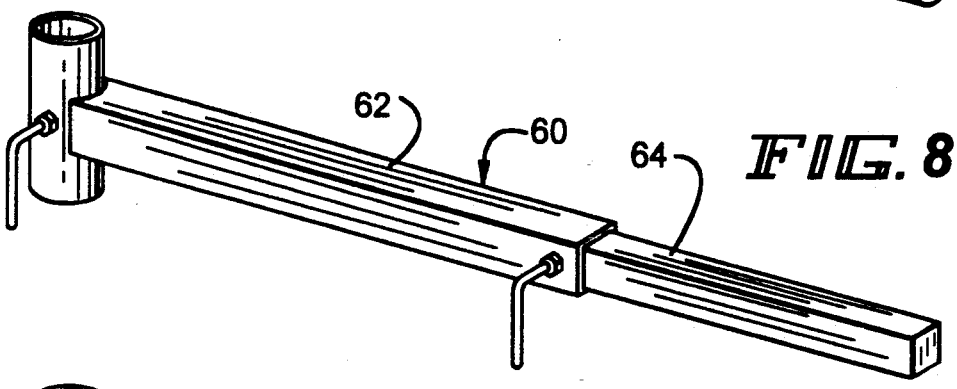
FIG. 8 is a front perspective view of a fourth embodiment of a support arm for use with the rack assembly of FIG. 1.

In FIG. 8, another embodiment of the extendable arm assembly 60 in the invention is shown having a similar design as the embodiment of FIG. 6 except that the cross-sectional configuration of the telescopic tubes 62 and 64 are square rather than tubular. Such a shape may be advantageous in certain situations, such as when it is desirable that the support surface of the arm be flat.

In the embodiment of FIG. 9, the extendable arm assembly 70 is shown having a similar configuration as the embodiment in FIG. 7, except that the support arm 72 and extendable end 74 are square in configuration.

Figure 10:
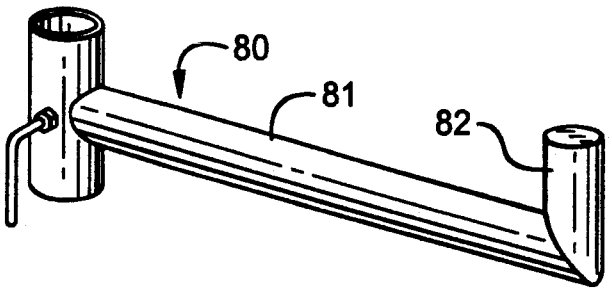
FIG. 10 is a front perspective view of a sixth embodiment of a support arm for use with the rack assembly of FIG. 1.

In FIG. 10, there is illustrated another version of a support arm assembly 80 which can be employed in connection with the vertical support tubes 4*a* and 4*b* of FIG. 1. The support arm assembly 80 is similar to the arm assembly shown in FIG. 1, except that the end of tube 81 includes an upright tube 82 which may be affixed thereto by welding and the like. The upright end section 82 aids in certain situations in retaining the load on the upper surface of the support arm where desirable.

What is claimed is:

1. A rack assembly comprising a plurality of elongated vertical support members disposed along parallel vertical axes, anchor means for anchoring said plurality of support members in fixed relationship adjacent to a side wall, a plurality of arm assemblies being pivotally affixed to said plurality of support members, each of said arm assemblies being swingable about, a respective one of said vertical support members in a plane perpendicular to said vertical axes, said arm assemblies further being vertically adjustable relative to said vertical support members, and retention means for locking said arm assemblies at a fixed position on a respective one of said arm assemblies.

2. The rack assembly according to claim 1 wherein each of said arm assemblies includes a tubular sleeve being slidably mounted on said vertical support members and a tubular arm affixed to said tubular sleeve.

3. The rack assembly according to claim 2 wherein said retention means includes a retention key affixed to said tubular sleeve.

4. The rack assembly according to claim 1 wherein said plurality of vertical members are tubular members.

5. The rack assembly according to claim 1 wherein said anchor means includes plates having raised flanges for respectively receiving the ends of said plurality of vertical members.

6. The rack assembly according to claim 1 wherein said anchor means includes a tubular sleeve mounted on said vertical support members and plate means being attached to a vertical wall for anchoring said vertical support members.

7. The rack assembly according to claim 7 wherein said retention means includes a retention element mounted on said tubular sleeve.

8. The rack assembly according to claim 1 wherein at least one of said arm assemblies includes an adjustable telescopic extension element, and means for affixing said extension element at selected lengths relative to said at least one of said arm assemblies.

9. The rack assembly according to claim 1 wherein at least one of said arm assemblies includes a cylindrical cross-sectional configuration.

10. The rack assembly according to claim 1 wherein at least one of said arm assemblies includes a rectangular configuration.

* * * * *